US009365054B2

(12) United States Patent
Chiba

(10) Patent No.: US 9,365,054 B2
(45) Date of Patent: Jun. 14, 2016

(54) RECORDING MEDIUM TRANSPORT DEVICE AND RECORDING DEVICE

(71) Applicant: Seiko Epson Corporation, Tokyo (JP)

(72) Inventor: Satoshi Chiba, Suwa (JP)

(73) Assignee: Seiko Epson Corporation (JP)

( * ) Notice: Subject to any disclaimer, the term of this patent is extended or adjusted under 35 U.S.C. 154(b) by 167 days.

(21) Appl. No.: 14/199,244

(22) Filed: Mar. 6, 2014

(65) Prior Publication Data

US 2014/0284177 A1 Sep. 25, 2014

(30) Foreign Application Priority Data

Mar. 22, 2013 (JP) ..... 2013-059600

(51) Int. Cl.
*B41J 11/00* (2006.01)

(52) U.S. Cl.
CPC ..... *B41J 11/007* (2013.01)

(58) Field of Classification Search
None
See application file for complete search history.

(56) References Cited

U.S. PATENT DOCUMENTS

| | | | | |
|---|---|---|---|---|
| 5,873,016 | A * | 2/1999 | Kurokawa et al. | 399/297 |
| 6,106,090 | A * | 8/2000 | Uchida et al. | 347/8 |
| 2002/0047887 | A1 * | 4/2002 | Koga et al. | 347/141 |
| 2007/0257955 | A1 * | 11/2007 | Tanaka et al. | 347/21 |
| 2007/0257963 | A1 * | 11/2007 | Tanaka et al. | 347/40 |
| 2011/0057990 | A1 * | 3/2011 | Heo et al. | 347/33 |
| 2011/0234662 | A1 * | 9/2011 | Tsuchiya | 347/9 |
| 2011/0292101 | A1 * | 12/2011 | Takeda et al. | 347/5 |
| 2015/0239264 | A1 * | 8/2015 | Ishizuka | 347/104 |

FOREIGN PATENT DOCUMENTS

| | | | |
|---|---|---|---|
| JP | 2000-284635 | A | 10/2000 |
| JP | 2004-130721 | A | 4/2004 |
| JP | 2004-161454 | A | 6/2004 |
| JP | 4640067 | B2 * | 3/2011 |

* cited by examiner

*Primary Examiner* — Justin Seo
(74) *Attorney, Agent, or Firm* — Harness, Dickey & Pierce, P.L.C.

(57) ABSTRACT

An ink jet printer includes a cleaning blade that cleans the surface of a transport belt that attracts a sheet of recording paper by electrostatic adsorption and transports the attracted recording paper, and a pressing roller. The width of the cleaning blade is smaller than the width of the pressing roller that is located downstream of the cleaning blade, and thus, ink, paper dust, and the like that have escapes from both ends of the cleaning blade to the outside and have not been wiped off are caught by the pressing roller.

18 Claims, 4 Drawing Sheets

3
3a
W7
P
10a
8
9a
10b
9
25
13
17
W1
W2
W3
W4
W5
W6

RECORDING MEDIUM TRANSPORT DEVICE AND RECORDING DEVICE

Priority is claimed under 35 U.S.C. §119 to Japanese Application No. 2013-059600 filed on Mar. 22, 2013, which is hereby incorporated by reference in its entirety.

BACKGROUND

1. Technical Field

The present invention relates to a recording medium transport device that transports a recording medium, and a recording device including the recording medium transport device.

2. Related Art

In a recording device that is represented by a printer, there is a case in which such a configuration is employed that a transport material, that is, a recording medium that is represented by a sheet of recording paper is transported using a transport belt. However, there is a case in which an accumulated material that originates from the recording medium, such as paper dust and fibers, and ink, attaches to the transport belt, and when the accumulated material and ink are transferred onto the recording medium, a reduction in the recording quality occurs. In particular, in the case of double-sided recording, ink, paper dust, and the like directly attach to the recording surface at the time of back-side recording, so that the recording quality is certainly reduced.

In addition, in the configuration in which the sheet of recording paper is transported using the transport belt, there is also a case in which the sheet of recording paper is attracted to the transport belt by electrostatic adsorption in order to prevent the sheet of recording paper from floating above the transport belt. In this case, paper dust, ink, and the like are more liable to attach to the transport belt, and for example, when ink attaches to the transport belt, there is a possibility that the electrical resistivity of the belt surface is reduced, and the transport belt cannot be charged appropriately.

In order to solve such problems, as an example of the related art, a device has been proposed that includes means for cleaning a transport belt as discussed in JP-A-2004-130721. An ink jet recording device that is discussed in JP-A-2004-130721 includes a cleaning blade. The cleaning blade comes into contact with the transport belt and wipes off ink that has attached to the belt surface.

As means for cleaning the transport belt that is provided in the recording device, in the related art, another configuration, for example, is employed in which a material that has accumulated on the belt surface is wiped off by an ink absorber in addition to the configuration in which the belt surface is wiped by the cleaning blade as described above.

Generally, a transport belt has a configuration of being spanned across a plurality of rotating bodies, and is driven. Here, there is a possibility that the transport belt moves in a belt width direction that is a thrust direction of the rotating bodies and is skewed, which causes a reduction in the recording quality. Therefore, in order to regulate such movement of the transport belt, as discussed in JP-A-2000-284635, there is a case in which projections that are called beads are provided on both edges of the inner surface of the belt, and both ends of the rotating body that the transport belt is spanned across are formed into a tapered shape, and the movement of the belt in the width direction is regulated by causing the beads to come into contact with the tapered portion.

In addition, it is necessary that looseness of the transport belt be regulated when the blade comes into contact with the belt surface because the cleaning blade comes into contact with the belt surface to wipe the belt surface. Therefore, it is desirable that the cleaning blade comes into contact with the belt surface at a position at which a certain configuration member exists on the inner surface of the belt, for example, at a position at which the rotating body exists.

Here, when the tapered portion that regulates the beads on the inner surface of the belt is provided on both ends of the rotating body, it is difficult to fix the position of the belt surface in this portion, and there is a possibility that the transport belt may break due to the movement of the beads onto the tapered portion, so that it is desirable that a configuration is employed in which the belt surface at the bead position is slightly sloped. Thus, in such a position, the cleaning blade is not practical, that is, the cleaning blade does not come into contact with the belt surface, and ink is not wiped off by the blade in the areas of both edges of the belt.

FIG. 4 is a cross-sectional view that indicates the axial end (axial end on one side) of the rotating body and the beads on the inner surface of the transport belt, and in FIG. 4, a transport belt 101, and a rotating body 103 that the transport belt 101 spans are illustrated. In FIG. 4, instead of the configuration in which the axial end of the rotating body 103 is formed into a tapered shape, a configuration is illustrated in which a skew regulation collar 104 that includes a taper 104*a* and regulates skew of the transport belt is used. Here, among the beads that are provided at both edges of the inner surface of the transport belt 101, beads 102 on one edge are illustrated. In the transport belt 101, skew is regulated by regulating movement in the right direction of FIG. 4 of the beads 102 using the taper 104*a*. On the other edge of the transport belt 101, the movement in the left direction of FIG. 4 of beads, which are not illustrated, is regulated.

It is difficult to fix the belt surface position in an area B outside the rotating body 103 in the transport belt 101, and there is a possibility that the transport belt 101 may become broken due to the movement of the beads 102 onto the taper 104*a*, so that a configuration may be employed in which the belt surface becomes slightly sloped at the position of the bead 102. In addition, there is a case in which the edge of the belt surface is slightly raised due to thermal contraction of the member depending on the configuration of the transport belt. Thus, in the area B, there is a case in which the cleaning blade is not practical or a case in which it is desirable that the cleaning blade does not come into contact with the belt surface.

In addition, in the case of the movement of the beads 102 onto the taper 104*a*, when the transport belt 101 comes into contact with the cleaning blade, there is a possibility that the transport belt 101 may become damaged. Thus, for that reason, it is desirable that the cleaning width of the transport belt 101 that is wiped by the cleaning blade is smaller than an area A of the rotating body 103.

For the above-described reason, when the width of the transport belt 101 is denoted as W6, the width of an area with which the transport belt 101 comes into contact in the rotating body 103 is denoted as W5, and the cleaning width of the transport belt 101 that is wiped by the cleaning blade is denoted as W3, it is desirable that "W6>W5>W3" is satisfied. The width W5 of the rotating body 103 indicates the width of an area with which the transport belt 101 comes into contact, and does not include the width of the skew regulation collar 104 and the width of the taper 104*a*.

In addition, when the maximum paper width is denoted as W1, and the width (length) of an area in which the charging roller charges the transport belt 101 is denoted as W2, it is desirable that "W2>W1" is satisfied from the viewpoint of sufficient electrostatic adsorption. In addition, it is desirable that the cleaning width W3 of the transport belt 101 that is wiped by the cleaning blade is larger than the width W2 of the area in which the charging roller charges the transport belt 101 so that ink that has attached to the belt surface does not adversely affect charging of the belt by the charging roller. From the above-described viewpoint, it is desirable that "W6>W5>W3>W2>W1" is satisfied in the relationship between the above-described dimensions.

In the relationship between the above-described dimensions, the cleaning width W3 of the transport belt 101 that is wiped by the cleaning blade is smaller than the belt width W6, but when the belt surface is wiped by the cleaning blade, the wiped-off ink and accumulated material escape from both ends of the blade to the outside, that is, the ink and material are not wiped off, and the accumulated ink and material come into contact with and attach to an ink jet head, so that there is a possibility that the accumulated ink and material adversely affect ink discharge. Such a technological problem has not been considered in the related arts.

SUMMARY

An advantage of some aspects of the present invention is that cleaning of a transport belt that transports a medium is further reliably performed.

A recording medium transport device according to a first aspect of the invention includes a transport belt that spans a plurality of rotating bodies including a first rotating body that is provided upstream in a transport direction of a recording medium for a recording area on which recording is performed by a recording section that performs recording on the recording medium, and a second rotating body that is provided downstream in the transport direction of the recording medium for the recording area, and transports the recording medium as a result of rotation of the plurality of rotating bodies, a first cleaning section that is arranged downstream of the recording area of the recording medium in a transport direction of the transport belt, and cleans the transport belt, a second cleaning section that is arranged downstream of the first cleaning section in the transport direction of the transport belt. In the recording medium transport device, a cleaning width of the transport belt by the first cleaning section in a width direction that is a direction perpendicular to a movement direction of the transport belt is smaller than a cleaning width of the transport belt by the second cleaning section in the width direction that is the direction perpendicular to the movement direction of the transport belt, and a cleaning area by the first cleaning section is located inside a cleaning area by the second cleaning section.

In the aspect, the recording medium transport device includes the first cleaning section, and the second cleaning section at the downstream of the first cleaning section, and the cleaning width in which the first cleaning section cleans the transport belt is smaller than the cleaning width by the second cleaning section, and the cleaning area by the first cleaning section is located inside the cleaning area by the second cleaning section, so that droplet, paper dust, and the like that escape from both ends of the first cleaning section to the outside and are not wiped off are captured by the second cleaning section. As a result, accumulation of the droplet, paper dust, and the like on the transport belt can be suppressed or prevented, and the transport belt can be further reliably cleaned.

In the recording medium transport device, the first cleaning section may include a blade member that wipes the belt surface of the transport belt. In this case, an effect of the above-described first aspect can be obtained in the configuration in which the first cleaning section wipes the belt surface by the blade member.

In the recording medium transport device, the blade member may come into contact with the transport belt at a position at which the belt surface faces downward in a range in which the transport belt spans the second rotating body.

In this case, the blade member comes into contact with the transport belt at the position at which the belt surface faces downward in the range in which the transport belt spans the second rotating body, so that the droplet, paper dust, and the like that have been captured by the blade member can be promoted to fall down, and it can be suppressed that the droplet, paper dust, and the like that have been captured by the blade member attach to the transport belt again.

In the recording medium transport device, the second cleaning section may include a fabric portion that wipes off a material that has accumulated on the transport belt. In this case, the second cleaning section includes the fabric portion that wipes off the material that has accumulated on the transport belt, so that the material that has accumulated on the belt surface can be excellently wiped.

The recording medium transport device may further include a belt charging section that charges the transport belt, and a width of a charging area in which the belt charging section charges the transport belt in the width direction that is the direction perpendicular to the movement direction of the transport belt is smaller than the cleaning width by the first cleaning section in the width direction that is the direction perpendicular to the movement direction of the transport belt, and the charging area is located inside the cleaning area by the first cleaning section.

In this case, the width of the charging area by the belt charging section in the width direction that is the direction perpendicular to the movement direction of the transport belt is smaller than the width of the cleaning area by the first cleaning section in the width direction that is the direction perpendicular to the movement direction of the transport belt, and the charging area is located inside the cleaning area by the first cleaning section, so that the charging area can be excellently cleaned, and the transport belt can be excellently charged.

In the recording medium transport device, the recording section may include a plurality of droplet discharge nozzles each of which discharges a droplet, and a width of an arrangement area of the droplet discharge nozzles in the width direction that is the direction perpendicular to the movement direction of the transport belt is smaller than the width of the charging area in the width direction that is the direction perpendicular to the movement direction of the transport belt, and the arrangement area of the droplet discharge nozzles is located inside the charging area.

In this case, the droplet discharge nozzle area is arranged within the excellently formed charging area, so that the medium is excellently attracted to the droplet discharge area of the transport belt, and an excellent droplet discharge result is obtained.

According to the recording medium transport device, in the transport direction of the transport belt, a length of a zone from the cleaning area by the second cleaning section to the charging area may be longer than a length of a zone from a cleaning area by the first cleaning section to the cleaning area by the second cleaning section.

In this case, in the transport direction of the transport belt, a distance from the second cleaning section to the belt charging section can be secured. That is, before the charging of the transport belt is completed, a dry time for the droplet that is left on the belt surface that has been cleaned by second cleaning section can be secured, and as a result, an excellent charging state can be obtained.

In the recording medium transport device, the transport belt may face the recording section in a belt zone between the first rotating body and the second rotating body, and in the transport direction of the transport belt, the recording area is located upstream of an intermediate position of the belt zone between the first rotating body and the second rotating body in the transport direction of the transport medium.

In this case, in the belt transport direction, a distance of positions between the recording section and the belt charging section can be secured, so that the dry time for the droplet that attaches to the belt surface can be secured before the charging of transport belt is completed, and as a result, the excellent charging state can be obtained. In addition, a space can be secured at the downstream of the recording section, so that arrangement of a detection section and the like, which detects transport failure (jam) of the medium, is facilitated.

In the recording medium transport device, the recording section may include a detection section that detects the recording medium on the transport belt, downstream in the transport direction of the recording medium, and the second cleaning section can perform switching between an execution state and a non-execution state of cleaning, and a control section that controls the second cleaning section to be switched from the non-execution state to the execution state when a certain time period elapses from a reference time and the detection section does not detect the recording medium.

In this case, transport failure (jam) of the medium can be detected using the detection section, and droplet discharge in a state in which there is no medium on the belt can be prevented.

According to a second aspect of the invention, a recording device includes a recording section that performs recording on a recording medium; and any one of the above-described recording medium transport devices, which is arranged opposite the recording section. In the aspect, an effect similar to any one of the above-described recording medium transport devices can be obtained in the recording device.

BRIEF DESCRIPTION OF THE DRAWINGS

The invention will be described with reference to the accompanying drawings, wherein like numbers reference like elements.

DESCRIPTION OF EXEMPLARY EMBODIMENTS

The embodiments of the invention are described below with reference to drawings, but the present invention is not limited to embodiments that are described below, and various modifications can be made within the scope of the invention described in the claims, and the embodiments of the invention are described below by assuming that they are also included within the scope of the invention.

Figure 1:
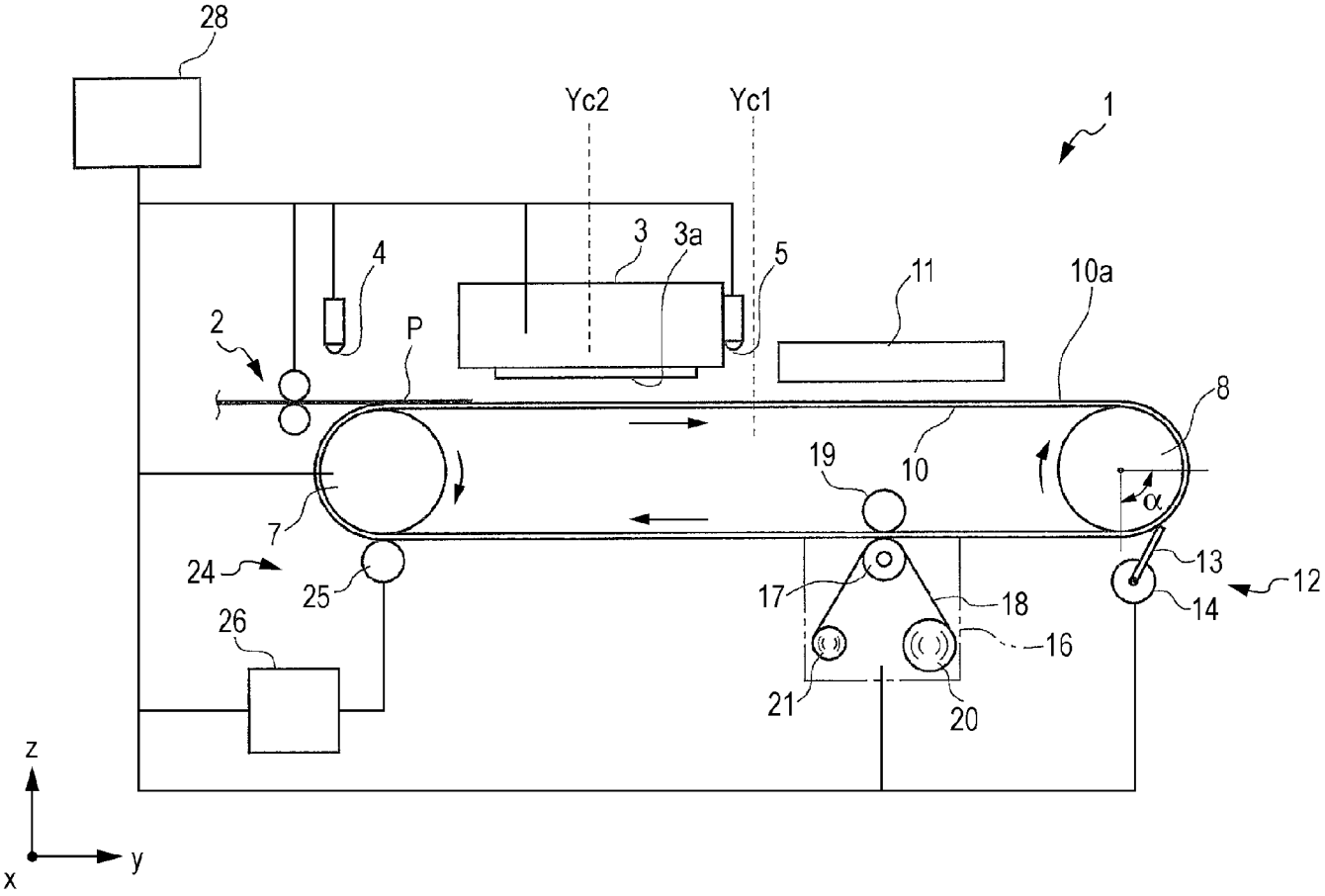
FIG. 1 is a side surface view of a recording section in an ink jet printer according to an embodiment.
Figures 2A, 2B, 2C, 2D, 2E, 2F:
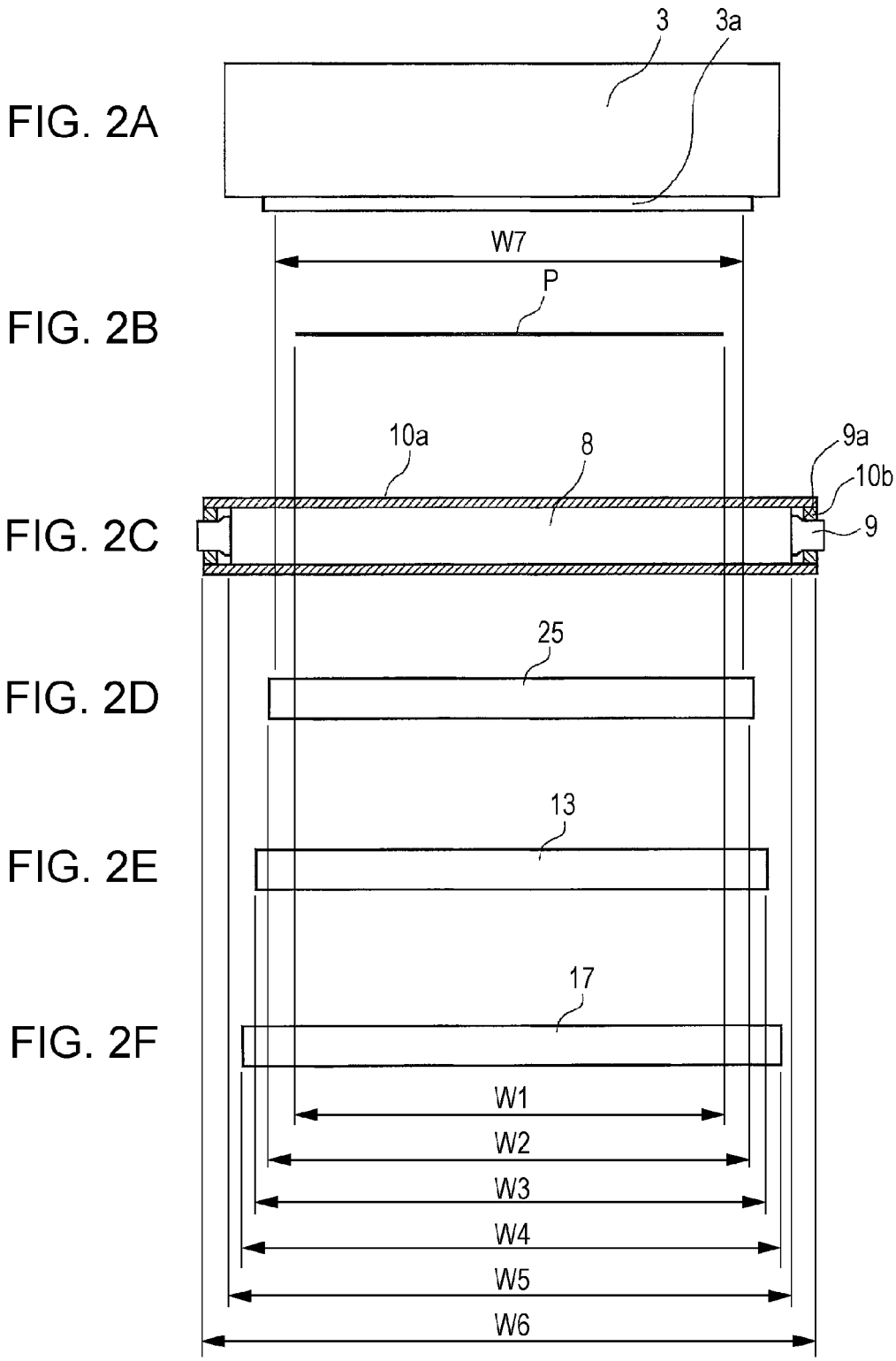
FIGS. 2A to 2F illustrate a plan view for comparing the width dimensions of an ink jet recording head, a sheet of recording paper, a drive roller and a transport belt, a charging roller, a cleaning blade, and a pressing roller.
Figure 3A:
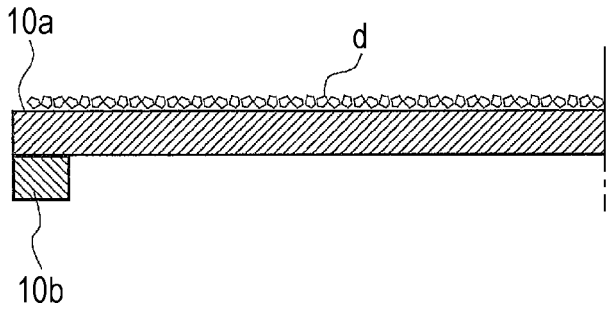
FIGS. 3A to 3C are schematic views illustrating a cleaning process of a belt surface that is wiped by the cleaning blade and a cleaning sheet.
Figure 3B:
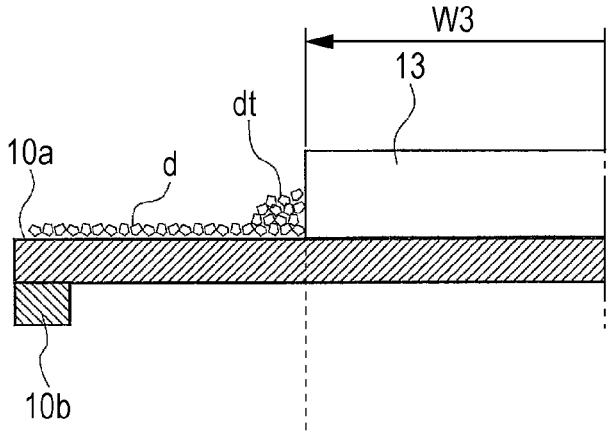
Figure 3C:
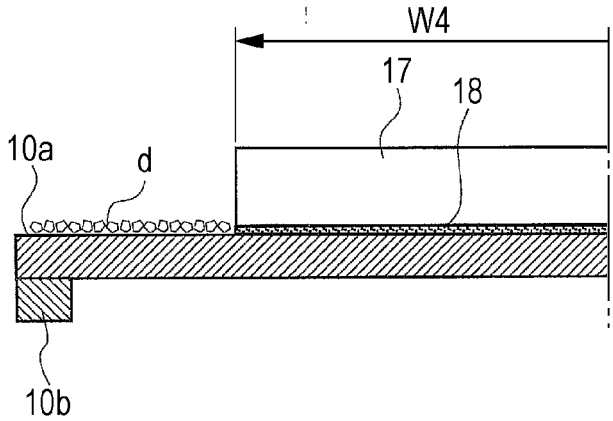

FIG. 1 is a side surface view of a recording section in an ink jet printer 1 that is a recording device according to an embodiment of the invention, and FIGS. 2A to 2F illustrate a plan view for comparing the width dimensions of an ink jet recording head 3, a sheet of recording paper P, a drive roller 7 as a rotating body and a transport belt 10, a charging roller 25, a cleaning blade 13, and a pressing roller 17, and FIGS. 3A to 3C are schematic views illustrating a cleaning process of a belt surface 10*a* that is wiped by the cleaning blade 13 and a cleaning sheet 18. In each of the figures, configuration elements of the ink jet printer 1 are simplified as appropriate.

In addition, in an x-y-z coordinate system illustrated in FIG. 1, an x direction and a y direction correspond to a horizontal direction, and the x direction corresponds to a paper width direction and a belt width direction (left-and-right direction of the device), and the y direction corresponds to the depth direction of the device and the transport direction of the paper. In addition, a z direction corresponds to a gravitational force direction (device height direction).

A description is made below using a sheet of recording paper that is a representative example of the recording medium, and the recording medium according to the invention may also be formed of a fabric, plastic, or the like, and the recording medium according to the invention is not limited to the sheet of recording paper.

In FIG. 1, the ink jet printer 1 includes a feed roller 2, and has a configuration in which the sheet of recording paper P, as an example of a transport material and a recording medium, is supplied to the transport belt 10 by such a feed roller 2. A feed section that is not illustrated in FIG. 1 and includes a removable paper cassette that accommodates the sheet of recording paper, and a feed roller that feeds the sheet of recording paper P from the paper cassette is provided upstream of the feed roller 2. In addition, a discharge section that discharges the sheet of recording paper P on which recording has been performed is also not illustrated.

The transport belt 10 is an endless belt that is used to transport the sheet of recording paper P so as to attract the sheet of recording paper P to the belt surface 10*a*, and spans the drive roller 7 as a first rotating body and a driven roller 8 as a second rotating body. The drive roller 7 and the driven roller 8 that are arranged downstream of the drive roller 7 are arranged in parallel at a certain distance from each other on a substantially horizontal surface, and therefore, the transport belt 10 has a substantially horizontal surface on both the upper portion and lower portion of the belt portion that is located between the drive roller 7 and the driven roller 8. The drive roller 7 may be changed to a driven roller, and the driven roller 8 may be changed to a drive roller, or both of the rollers may be drive rollers.

The drive roller 7 is configured to perform rotation drive by a drive motor that is not illustrated, and drive control of the drive motor is performed by a control section 28, and as a result, the transport belt 10 is driven by a certain movement amount at a certain movement speed in a certain direction at a certain timing. The arrows in FIG. 1 (right arrow and left arrow) indicate belt rotation (movement) directions, and the curved arrows that are illustrated next to the drive roller 7 and the driven roller 8 indicate the rotation directions of both rollers.

As described later, the transport belt 10 is charged into a certain state by a belt charging section 24, and as a result, electrostatic adsorption is performed on the sheet of recording paper P. Therefore, the transport belt 10 is formed using resin having a surface (outer surface) with at least medium resistance ($1\times10^{10}$ Ω/square or less) or high resistance (higher resistance than $1\times10^{10}$ Ω/square), for example, an insulating material such as polyethylene terephthalate (PET), polyimide, fluorinated resin, and rubber, and the resistance is adjusted by mixing carbon black and a conductive filler into the material as appropriate to adjust a holding charge amount for charging.

The ink jet recording head 3 as an example of a recording section that performs recording on the recording medium is arranged above the transport belt 10 so as to be opposite the planar surface of the transport belt 10. The ink jet recording head 3 includes nozzle columns (not illustrated) that discharge, for example, ink drops (droplets) of four colors such as yellow (Y), magenta (M), cyan (C), and black (K) from the upstream side in the paper transport direction. In addition, the nozzle columns discharge the ink drops to the sheet of recording paper P that is transported by the transport belt 10 at certain timings, respectively, under control of the control section 28 to form a color image.

Ink tanks (not illustrated) that respectively store inks having colors of Y, M, C, and K, are removably mounted on a device body (not illustrated) of the ink jet printer 1, and the inks are supplied from the ink tanks to the ink jet recording head 3 through ink tubes that are not illustrated.

In the embodiment, the ink jet recording head 3 is a head that is elongated along the paper width direction (x direction) that is a direction perpendicular to the paper transport direction, that is, a non-scanning type head that is formed so as to have a length that allows the nozzles that discharge the ink to cover the whole width of a sheet of paper having the largest size, out of sheets of recording paper P that are to be used. However, the invention is not limited to such an example, and the ink jet recording head 3 may be a scanning type head that discharges the ink while moving in the paper width direction (x direction), that is, a so-called serial type recording head. In FIG. 2, the symbol W7 indicates the arrangement area width of the ink discharge nozzles in the paper width direction, that is, the maximum width of a recordable area.

In addition, a nozzle plate 3*a* that forms a surface that faces the transport belt 10 in the ink jet recording head 3 and on which an ink discharge hole (not illustrated) is formed may be formed using a conductor such as a metal, an insulator such as silicon, or a semiconductor. In addition, the lower surface (nozzle formation surface) of the nozzle plate 3*a* is directed to the upper surface of the transport belt 10, and the nozzle formation surface is arranged so as to be separated from the belt surface 10*a* of the transport belt 10 at a certain distance.

In the ink jet recording head 3, a second paper detection sensor 5 is provided downstream in the movement direction of the belt, as a detection section. The second paper detection sensor 5 is an optical sensor, includes a light-emitting section and a light-receiving section that are not illustrated, receives light that is emitted from the light-emitting section at the light-receiving section, and transmits a detection signal based on the light amount to the control section 28. As a result, the control section 28 can detect the passing of the proximal end and the distal end of the sheet of recording paper P, and can grasp the length of the sheet of recording paper P and the drive speed of the transport belt 10.

In addition, a first paper detection sensor 4 is provided downstream of the feed roller 2 and upstream of the ink jet recording head 3. The first paper detection sensor 4 is an optical sensor that has a configuration similar to the second paper detection sensor 5, and the control section 28 of the ink jet printer 1 can control the arrival timing of the sheet of recording paper P at the transport belt 10 by receiving the detection signal from the first paper detection sensor 4.

A cap unit 11 is provided downstream of the ink jet recording head 3. The ink jet recording head 3 is caused to rise and fall by a lifting mechanism that is not illustrated, and the cap unit 11 is caused to move to the lower side of the ink jet recording head 3 that is in the raised position by a movement mechanism that is not illustrated. In addition, in such a state, when the ink jet recording head 3 falls, the nozzle plate 3*a* is capped, and ink in the nozzle opening is prevented from drying out, and maintenance work may be performed on the ink discharge nozzles.

In addition, a first cleaning section 12 is provided downstream of the driven roller 8. The first cleaning section 12 includes the cleaning blade 13, and wipes off an accumulated material such as ink, paper dust, and the like that have attached to the belt surface 10*a* by wiping the belt surface 10*a* of the transport belt 10. The cleaning blade 13 may be formed using various materials, and it is desirable that the cleaning blade 13 is formed of, for example, a plastic member such as PET, or a material having flexibility such as a rubber.

The cleaning blade 13 comes into contact with the transport belt 10 with a certain contact angle and contact pressure at a position (fourth quadrant: range of an angle α) at which the belt surface 10*a* faces downward, in the spanning range of the driven roller 8 of the transport belt 10 (range that corresponds to the first quadrant and the fourth quadrant of a circle that indicates the driven roller 8 in FIG. 1).

As a result, the ink, paper dust, and the like that are captured by the cleaning blade 13 can be facilitated to fall downward, and reattachment of the ink drops, paper dust, and the like that have been captured by the cleaning blade 13 on the transport belt 10 can be suppressed.

The cleaning blade 13 can switch between being in a state in which the blade proximal end comes into contact with the transport belt 10 by power of a motor 14, that is, a cleaning execution state, to a state in which the blade proximal end is separated from the transport belt 10, that is, a cleaning non-execution state. The motor 14 causes the cleaning blade 13 to switch between the above-described two states under control of the control section 28.

Generally, the first cleaning section 12 keeps the state in which the cleaning blade 13 is in contact with the transport belt 10, that is, the cleaning execution state. In addition, when the control section 28 determines that a paper jam has occurred, the state is switched from the cleaning execution state to the cleaning non-execution state under control of the control section 28.

In addition, a second cleaning section 16 is provided downstream of the first cleaning section 12. The second cleaning section 16 includes the pressing roller 17, a supply roller 21, a take-up roller 20, a pressing roller 19, and the cleaning sheet 18.

The cleaning sheet 18 is formed of a fabric, and the cleaning sheet 18 is fed from the supply roller 21 and taken up by the take-up roller 20. The cleaning sheet 18 is pressed against the transport belt 10 by the pressing roller 17, and as a result, a material that has accumulated on the belt surface 10*a* is wiped off by the cleaning sheet 18, and the ink, paper dust, and the like are removed. It is desirable that the outer surface of the pressing roller 17 is formed using an elastic member such as a rubber material in order to obtain excellent dispel resistance of the accumulated material and protect the transport belt 10. In addition, in this case, it is desirable that the pressing roller 19 inside the belt is formed using a material having high rigidity (for example, a metal). The cleaning sheet 18 is not limited as long as the sheet is something such as a sponge member that removes the material that has accumulated on the belt.

The supply roller 21 and the take-up roller 20 are driven so that the cleaning sheet 18 moves in a direction that is opposite to the movement direction of the transport belt 10 at the time of cleaning (in this case, both rollers rotate in a clockwise direction in FIG. 1). Alternatively, the rollers may rotate in an anti-clockwise direction.

In addition, the pressing roller 17 can switch the state between the state in which the cleaning sheet 18 comes into contact with the transport belt 10 by a lifting mechanism that is not illustrated, that is, the cleaning execution state, and the state in which the cleaning sheet is separated from the transport belt 10, that is, the cleaning non-execution state. The second cleaning section 16 switches the above-described two states under control of the control section 28.

Generally, the second cleaning section 16 keeps the above-described cleaning non-execution state. In addition, when the control section 28 determines that paper jam occurs, the state is switched from the cleaning non-execution state to the cleaning execution state under control of the control section 28.

In the embodiment, the control section 28 determines that transport failure of the recording medium occurs as follows. As an example, first, a time at which the first paper detection sensor 4 detects the passing of the proximal end of the recording medium (for example, the sheet of recording paper P) is set as a reference time. In addition, it is determined that transport failure (paper jam) of the recording medium occurs in a case in which the second paper detection sensor 5 does not detect the passing of the proximal end of the sheet of recording paper P even when a time period elapses that is obtained by adding a margin to same extent to a certain time period that is calculated on the basis of a drive amount of the transport belt 10, for example, a scheduled time period until the passing of the proximal end of the sheet of recording paper P is detected by the second paper detection sensor 5 after the passing of the proximal end of the sheet of recording paper P has been detected by the first paper detection sensor 4.

It is desirable that the reference time is determined as the time of detection of the passing of the proximal end of the recording medium, but the embodiments are not limited to such an example, and the distal end of the recording medium may be determined as a detection portion, or a location at which a depression, a hole, or the like is provided in the recording medium may be determined as the detection portion.

When paper jam occurs, there is a possibility that ink is discharged from the ink jet recording head 3 to transport belt 10 in the no-paper state, that is, the belt surface 10*a* becomes significantly dirty. Thus, in this case, in order to use the second cleaning section 16 having excellent ink trapping, the state of the first cleaning section 12 is switched from the cleaning execution state to the non-execution state, and the state of the second cleaning section 16 is switched from the cleaning non-execution state to the execution state. As a result, the ink that has attached to the belt surface 10*a* is excellently removed.

In addition, the belt charging section 24 that charges the transport belt 10 under control of the control section 28 is provided on the lower side of the drive roller 7. The belt charging section 24 includes a charging roller 25, and a voltage applying section 26 that applies voltage to the charging roller 25.

The voltage applying section 26 is a power source device that includes an alternating current (AC) power source, a direct current (DC) power source, and a known switching regulator, and performs rectification of AC voltage, reversal of polarity, pulse modulation, and the like. The voltage applying section 26 applies certain AC voltage or DC voltage to the charging roller 25 under control of the control section 28, so that plus charging areas and minus charging areas are formed alternately on the transport belt 10 along the belt movement direction. The charging roller 25 is formed, for example, by a conductive rubber member and the like.

A static eliminating section that eliminates the charging state of the transport belt 10 beforehand may be provided upstream of the belt charging section 24. As the static eliminating section, various types of static eliminating section such as a known ion static eliminating device and a self-discharge type static eliminator that is represented by a static eliminating brush may be employed.

In addition, the positional relationship in the belt movement direction between the ink jet recording head 3, the cleaning blade 13 of the first cleaning section 12, the pressing roller 17 of the second cleaning section 16, and the charging roller 25 of the belt charging section 24 is described below.

The ink jet recording head 3 faces the transport belt 10 within the belt zone (upper side) between the drive roller 7 and the driven roller 8, and as illustrated in FIG. 1, in the movement direction of the transport belt 10, the recording area by the ink jet recording head 3 is located upstream of the intermediate position Yc1 of the belt zone (upper side) between the drive roller 7 and the driven roller 8. More preferably, it is desirable that the recording area is arranged at a location that is biased to the upstream of the intermediate position Yc1.

Therefore, a distance between the positions of the ink jet recording head 3 and the charging roller 25 can be secured, so that a dry time for an ink drop that has attached to the belt surface 10*a* can be secured before the charging of the transport belt 10 is completed, and as a result, an excellent charging state can be obtained. In addition, a space can be provided downstream of the ink jet recording head 3, so that the second paper detection sensor 5 and the like, which detects paper jam are arranged easily.

The position at which the recording area by the ink jet recording head 3 is biased to the upstream of the intermediate position Yc1 of the belt zone (upper side) does not necessarily indicate a position at which the whole recording area is located upstream of the intermediate position Yc1, but indicates, for example, a position at which the intermediate position Yc2 of the recording area is located upstream of the intermediate position Yc1 of the belt zone (upper side).

The length of a portion at which the pressing roller 17 of the second cleaning section 16 comes into contact with the transport belt 10 through the cleaning sheet 18, that is, the length of the belt zone that ranges from the cleaning area by the second cleaning section 16 to the charging area by the charging roller 25 is denoted as L2. In addition, the length of a portion at which the cleaning blade 13 of the first cleaning section 12 comes into contact with the transport belt, that is, the length of the belt zone that ranges from the cleaning area by the first cleaning section 12 to the cleaning area by the second cleaning section 16 is denoted as L1. In the embodiment, "L2>L1" is set.

Therefore, the long distance from the cleaning area by the second cleaning section 16 to the charging area can be secured. That is, before the charging of the transport belt 10 is completed, a dry time for an ink drop that is left on the belt surface 10*a* that has been cleaned by the second cleaning section 16 can be secured, and as a result, an excellent charging state can be obtained.

In addition, width dimensions of the configuration elements and a positional relationship between the configuration elements are described with reference to FIG. 2. In FIG. 2, the symbol W1 indicates the maximum width of the sheet of recording paper P. The symbol W2 indicates the width of the charging area by the charging roller 25. The symbol W3 indicates the cleaning width of the transport belt that is wiped by the cleaning blade 13. The symbol W4 indicates a width in which the pressing roller 17 presses the cleaning sheet 18, that is, the cleaning width by the second cleaning section 16. The symbol W5 indicates the width of an area in which the driven roller 8 comes into contact with the transport belt 10. The symbol W6 indicates the width of the transport belt 10.

As illustrated in FIG. 2, in the embodiment, in the magnitude relationship between W1 to W6, "W6>W5>W4>W3>W2>W1" is satisfied. In addition, the area of the width W5 is arranged inside the area of the width W6. Similarly, the area of the width W4 is arranged inside the area of the width W5. In addition, the area of the width W3 is arranged inside the area of the width W4. In addition, the area of the width W2 is arranged inside the area of the width W3. In addition, the area of the width W1 is arranged inside the area of the width W2.

Figure 4:
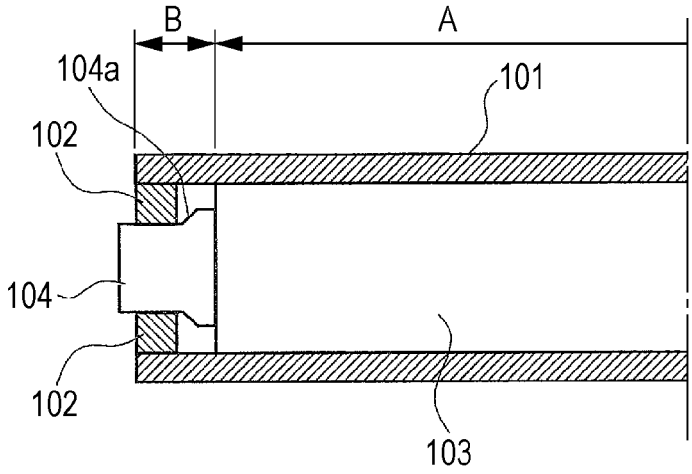
FIG. 4 is a cross-sectional view of the edge of a transport belt and a rotating body in a related art.

In FIG. 2C, a skew regulation collar 9 includes a taper 9*a*. Such a configuration is similar to the configuration that is described above with reference to FIG. 4, but again, beads 10*b* are provided at the edges of the inner surface of the transport belt 10, and the skew of the transport belt 10 is regulated when the movement of the bead 10*b* in the lateral direction of FIG. 2 is regulated by the taper 9*a* of the skew regulation collar 9.

In an area outside the driven roller 8 in the transport belt 10 (outside the range W5), it is difficult to fix the belt surface position, and there is a possibility that the transport belt 10 may become broken due to the movement of the bead 10*b* onto the taper 9*a*, so that a configuration is employed in which the belt surface 10*a* at the position of the bead 10*b* is slightly sloped. Thus, in this area, the cleaning blade 13 is not practical.

In the above-described embodiments, the example is described in which the belt surface 10*a* is slightly sloped at the belt end, but the state of the belt end is not limited to such an example. For example, even in a case in which the belt end is slightly raised, the portion of the bead 10*b* is not backed up by the roller, so that harmful effect occurs that it is difficult to cause the contact pressure by the cleaning blade 13 or the like to be acted appropriately. Even in this case, the harmful effect can be eliminated by employing the above-described width relationship.

In addition, when the transport belt 10 comes into contact with the cleaning blade 13 at the time of movement of the bead 10*b* onto the taper 9*a*, there is a possibility that the transport belt 10 may become damaged. Thus, for that reason, it is desirable that the cleaning width W3 of the transport belt 10 that is wiped by the cleaning blade 13 is smaller than the width W5 in which the driven roller 8 comes into contact with the transport belt 10.

In addition, from the viewpoint of sufficient electrostatic adsorption, it is desirable that the width of the area in which the charging roller 25 charges the transport belt 10 is larger than the paper width, that is, "W2>W1" is satisfied. In addition, it is desirable that the cleaning width W3 of the transport belt 10 that is wiped by the cleaning blade 13 is larger than the width W2 of the area in which the charging roller 25 charges the transport belt 10 so that the ink that has attached to the belt surface 10*a* does not adversely affect the belt charging by the charging roller 25. From the above-described viewpoint, it is desirable that "W6>W5>W3>W2>W1" is satisfied in the dimension relationship.

Here, in the above-described dimension relationship, the cleaning width W3 of the transport belt 10 that is wiped by the cleaning blade 13 is smaller than the belt width W1, but in the case in which the belt surface 10*a* is wiped by the cleaning blade 13, the wiped-off ink and paper dust escape from both ends of the cleaning blade 13 to the outside, that is, are not wiped off, and the accumulated material comes into contact with the ink jet recording head 3 and attaches to the ink jet recording head 3 in the end, so that there is the possibility that the accumulated material adversely affects ink discharge.

However, the cleaning width W3 of the transport belt 10 that is wiped by the cleaning blade 13 is smaller than the cleaning width W4 of the transport belt 10 by the pressing roller 17 that is located downstream of the cleaning blade 13 (the cleaning sheet 18 has the same width), and the cleaning area that is wiped by the cleaning blade 13 is located inside the cleaning area by the cleaning sheet 18, so that the ink, paper dust, and the like that has escaped from both ends of the cleaning blade 13 to the outside and has not been wiped off are captured by the pressing roller 17.

FIGS. 3A to 3C schematically illustrate such a state, and when cleaning is performed by the cleaning blade in a state in which ink, paper dust, and the like (referred to as a foreign matter d) attach to the belt surface 10*a* (FIG. 3A), the foreign matter d escapes from both ends of the cleaning blade 13 to the outside, and becomes an accumulated material dt as illustrated in FIG. 3B. There is a possibility that the accumulated material dt attaches to the ink jet recording head 3 in the end.

However, the second cleaning section 16 that is arranged downstream of the cleaning blade 13 includes the pressing roller 17 and the cleaning sheet 18 that are wider than the cleaning blade 13, so that the accumulated material dt is captured (FIG. 3C). As a result, accumulation of the ink drop, paper dust, and the like on the transport belt 10 can be suppressed or prevented, and the transport belt 10 can be further reliably cleaned.

In addition, in the embodiments, the width W3 of the charging area in which the charging roller 25 charges the transport belt 10 is smaller than the cleaning width by the first cleaning section 12, and the charging area is located inside the cleaning area by the first cleaning section 12. Thus, the charging area can be excellently cleaned, and the transport belt 10 can be excellently charged.

In addition, in the embodiment, the arrangement area width W7 of the ink discharge nozzles is smaller than the width W3 of the charging area, and the arrangement area of the ink discharge nozzles is located inside the charging area. As a result, the recording medium is excellently attracted to the transport belt 10 in the ink discharge area, that is, the recording area, and an excellent ink discharge result is obtained.

As described above, the above-described embodiments are merely examples, and it goes without saying that the invention is not limited to such examples. In particular, in the embodiments, the invention is applied to the ink jet printer, but the invention may be also applied to a general liquid ejecting apparatus. Here, as the liquid ejecting apparatus, a device is employed that ejects liquid that meets the intended purpose of ink instead of the ink, to an ejecting medium that corresponds to the recording medium, from a liquid ejecting head that corresponds to the ink jet type recording head, and causes the liquid to attach to the ejecting medium in addition to a recording device such as a printer, a copying machine, and a facsimile, in which an ink jet type recording head is used, and that discharges ink from the recording head to perform recording on the recording medium.

As the liquid ejecting head, in addition to the recording head, a color member ejecting head that is used to manufacture a color filter of a liquid crystal display or the like, an electrode member (conductive paste) ejecting head that is used to form an electrode of organic electroluminescent (EL) display, a field emission display (FED) and the like, a bio-organic material ejecting head that is used to manufacture a biochip, and a sample ejecting head as a precision pipette may be employed.

What is claimed is:

1. A recording medium transport device comprising:

a transport belt that spans a plurality of rotating bodies including a first rotating body that is provided upstream in a transport direction of a recording medium for a recording area on which recording is performed by a recording section that performs recording on the recording medium, and a second rotating body that is provided downstream in the transport direction of the recording medium for the recording area, and transports the recording medium as a result of rotation of the plurality of rotating bodies;

a first cleaning section that is arranged downstream of the recording area of the recording medium in a transport direction of the transport belt, and cleans the transport belt; and a second cleaning section that is arranged downstream of the first cleaning section in the transport direction of the transport belt, wherein a cleaning width of the transport belt by the first cleaning section in a width direction that is a direction perpendicular to a movement direction of the transport belt is smaller than a cleaning width of the transport belt by the second cleaning section in the width direction that is the direction perpendicular to the movement direction of the transport belt, and a cleaning area by the first cleaning section is located inside a cleaning area by the second cleaning section.

2. The recording medium transport device according to claim 1, wherein the first cleaning section includes a blade member that wipes a belt surface of the transport belt.

3. The recording medium transport device according to claim 2, wherein the blade member comes into contact with the transport belt at a position at which the belt surface faces downward in a range in which the transport belt spans the second rotating body.

4. The recording medium transport device according to claim 1, wherein the second cleaning section includes a fabric portion that wipes off a material that has accumulated on the transport belt.

5. The recording medium transport device according to claim 1 further comprising:

a belt charging section that charges the transport belt, and a width of a charging area in which the belt charging section charges the transport belt in the width direction that is the direction perpendicular to the movement direction of the transport belt is smaller than the cleaning width by the first cleaning section in the width direction that is the direction perpendicular to the movement direction of the transport belt, and the charging area is located inside the cleaning area by the first cleaning section.

6. The recording medium transport device according to claim 5, wherein the recording section includes a plurality of droplet discharge nozzles each of which discharges a droplet, and a width of an arrangement area of the droplet discharge nozzles in the width direction that is the direction perpendicular to the movement direction of the transport belt is smaller than the width of the charging area in the width direction that is the direction perpendicular to the movement direction of the transport belt, and the arrangement area of the droplet discharge nozzles is located inside the charging area.

7. The recording medium transport device according to claim 5, wherein in the transport direction of the transport belt, a length of a zone from the cleaning area by the second cleaning section to the charging area is longer than a length of a zone from a cleaning area by the first cleaning section to the cleaning area by the second cleaning section.

8. The recording medium transport device according to claim 1, wherein the transport belt faces the recording section in a belt zone between the first rotating body and the second rotating body, and in the transport direction of the transport belt, the recording area is located upstream of an intermediate position of the belt zone between the first rotating body and the second rotating body in the transport direction of the transport medium.

9. The recording medium transport device according to claim 1, wherein the recording section includes a detection section that detects the recording medium on the transport belt, downstream in the transport direction of the recording medium, the second cleaning section performs switching between an execution state and a non-execution state of cleaning, and a control section that controls the second cleaning section is switched from the non-execution state to the execution state when a certain time period elapses from a reference time and the detection section does not detect the recording medium.

10. A recording device comprising:

a recording section that performs recording on a recording medium; and the recording medium transport device according to claim 1 that is arranged opposite the recording section.

11. A recording device comprising:

a recording section that performs recording on a recording medium; and the recording medium transport device according to claim 2 that is arranged opposite the recording section.

12. A recording device comprising:

a recording section that performs recording on a recording medium; and the recording medium transport device according to claim 3 that is arranged opposite the recording section.

13. A recording device comprising:

a recording section that performs recording on a recording medium; and the recording medium transport device according to claim 4 that is arranged opposite the recording section.

14. A recording device comprising:

a recording section that performs recording on a recording medium; and the recording medium transport device according to claim 5 that is arranged opposite the recording section.

15. A recording device comprising:

a recording section that performs recording on a recording medium; and the recording medium transport device according to claim 6 that is arranged opposite the recording section.

16. A recording device comprising:

a recording section that performs recording on a recording medium; and the recording medium transport device according to claim 7 that is arranged opposite the recording section.

17. A recording device comprising:

a recording section that performs recording on a recording medium; and the recording medium transport device according to claim 8 that is arranged opposite the recording section.

18. A recording device comprising:

a recording section that performs recording on a recording medium; and the recording medium transport device according to claim 9 that is arranged opposite the recording section.

* * * * *